US009850434B2

(12) United States Patent
Sugita et al.

(10) Patent No.: US 9,850,434 B2
(45) Date of Patent: Dec. 26, 2017

(54) REDUCTION OF COKING IN FCCU FEED ZONE

(71) Applicants: Masaaki Sugita, The Woodlands, TX (US); Christopher Gordon Smalley, Manassas, VA (US); Brian A. Cunningham, Gladstone, NJ (US); Timothy Forbes, Houston, TX (US); Tarrant Jay Falcke, Kingsville (AU); Nicholas E. Smith, Albert Park (AU)

(72) Inventors: Masaaki Sugita, The Woodlands, TX (US); Christopher Gordon Smalley, Manassas, VA (US); Brian A. Cunningham, Gladstone, NJ (US); Timothy Forbes, Houston, TX (US); Tarrant Jay Falcke, Kingsville (AU); Nicholas E. Smith, Albert Park (AU)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 0 days.

(21) Appl. No.: 14/953,674

(22) Filed: Nov. 30, 2015

(65) Prior Publication Data

US 2016/0177189 A1 Jun. 23, 2016

Related U.S. Application Data

(60) Provisional application No. 62/103,778, filed on Jan. 15, 2015, provisional application No. 62/093,721, filed on Dec. 18, 2014.

(51) Int. Cl.
*C10G 11/18* (2006.01)

(52) U.S. Cl.
CPC ..... *C10G 11/187* (2013.01); *C10G 11/18* (2013.01); *C10G 2300/107* (2013.01); *C10G 2300/1033* (2013.01); *C10G 2300/1074* (2013.01); *C10G 2300/1077* (2013.01); *C10G 2300/708* (2013.01); *C10G 2400/20* (2013.01)

(58) Field of Classification Search
CPC ..... C10G 11/18; C10G 11/187
See application file for complete search history.

(56) References Cited

U.S. PATENT DOCUMENTS

2014/0305841 A1* 10/2014 Du ..... B01J 8/085 208/113

OTHER PUBLICATIONS

R.G. McClung, "Monitoring FCCU Feed Vaporization", available at http://www.refiningonline/engelhardkb/crep//TCR1_7.htm, downloaded on Nov. 4, 2015.

* cited by examiner

*Primary Examiner* — Brian McCaig
(74) *Attorney, Agent, or Firm* — Hsin Lin; Chad A. Guice

(57) ABSTRACT

A method of predicting the tendency of a heavy oil feed to generate coke deposits in the FCC riser under a given set of operating parameters in the unit; thus, by utilizing operating parameters appropriate to the feed, the formation of coke deposits in the riser may be minimized. The margin between the theoretical dew point of the hydrocarbon feed established from unit operating parameters and the theoretical mix zone temperature in the feed injection zone of the unit is developed by applying a regression-derived linear model from multiple rigorous model runs. The mix zone of the unit is then operated at a temperature which reduces the level of riser coking predicted from this ascertainable margin or, at least, maintains it within levels which are predictable and acceptable.

20 Claims, 4 Drawing Sheets

Feed Zone Dew Point Margin Prediction

Unvaporized Feed in the Feed Zone Estimation vs Dew Point

FCC Riser Pressure Delta vs Model Prediction

REDUCTION OF COKING IN FCCU FEED ZONE

CROSS-REFERENCE TO RELATED APPLICATION

This Non-Provisional patent application claims priority to U.S. Provisional Application Ser. No. 62/103,778, filed Jan. 15, 2015 and to U.S. Provisional Application Ser. No. 62/093,721 filed Dec. 18, 2014, herein incorporated by reference in their entirety.

FIELD OF THE INVENTION

The present invention relates to a method of reducing the incidence of coking, especially with heavy oil feeds, in the feed injection zone of fluid catalytic cracking units.

BACKGROUND OF THE INVENTION

The Fluid Catalytic Cracking (FCC) process is now the predominant process in the petroleum refining industry for the boiling range conversion of the high-molecular weight hydrocarbon fractions of petroleum crude oils to more valuable gasoline, olefins and other products which may be passed to other refining processes such as hydrocracking.

Various types of FCC process unit (FCCU) exist with variant designs being offered by technology licensors in the industry. In principle, however, all hark back to the original design from Esso in the early 1940s with a reactor vessel and a regenerator vessel with a finely-divided solid, particulate catalyst circulating continuously between them. Current designs carry out the cracking of the feed in a riser which is a substantially vertical pipe with a feed injection zone at the bottom into which hot catalyst from the regenerator is fed to meet the incoming feed which is injected into the mix zone through nozzles with aid of steam. The regenerated catalyst enters the riser below the feed mix zone and is lifted up into the mix zone with lift gas. In the riser the vaporized feed is cracked into smaller molecules of vapor by contact and mixing with the hot catalyst; the cracking reactions take place in the catalyst riser within 10 seconds, typically 2-4 seconds. The mixture of hydrocarbon vapors and catalyst flows upward to enter the reactor vessel which now functions as a disengager to permit separation of the spent catalyst from the cracked hydrocarbon vapors. The spent catalyst flows downward through a steam stripping section to remove any hydrocarbon vapors before the spent catalyst returns to the catalyst regenerator where the coke which accumulates on the catalyst particles as a result of the carbon rejection which is the characteristic feature of the process is burned off with air to restore catalyst activity and selectivity as well as providing heat by the exothermic combustion of the coke to maintain a heat balance in the unit with the endothermic cracking reactions.

The feedstock to the FCCU is usually that portion of the crude oil that has an initial boiling point of 340° C. or higher at atmospheric pressure and an average molecular weight ranging from about 200 to 600 or higher. This portion of crude oil is typically the high boiling fraction from the vacuum distillation tower often referred to as heavy gas oil or vacuum gas oil (HVGO or VGO) although in recent years cracking of residual fractions has become more common and in addition, the end points of the gas oil fractions have increased in order to secure the maximum economic profit from available crude sources. With this trend towards higher boiling feeds, however, have come attendant difficulties. Not only do the feeds tend to produce more carbon during the process (an inevitable result of the carbon rejection) but "coking" or the formation of highly carbonaceous fouling deposits in the unit has become more prevalent and, with continued accumulation, can lead to shut down of the unit. Some units have experienced unexpected feed zone coking that forced unit shut-down for cleaning. Existing operating envelopes including factors such as feed nozzle minimum pressure drop and ratio of feed injection steam to fresh feed were found to be inadequate for predicting coke growth in the feed zone.

The formation of coke fouling deposits may occur at various locations in the unit, including the interior of the reactor as a black deposit on the surface of the cyclone barrels, reactor dome, and walls, the transfer line from the reactor vessel to the main fractionation column, in the slurry oil circulating slurry system where it is likely to plug up exchangers, resulting in lower slurry circulation rates and reduced heat removal. Another site where coking is often encountered is in the riser, notably in the feed injection zone where the stream of hot catalyst from the regenerator meets the pre-heated feed injected with steam through the injection nozzles. Coking in the riser is a particular problem since reductions in the already limited size of the riser can increase the pressure drop, leading to catalyst circulation capability problems in the upper end and loss of throughput.

Coke-induced fouling is believed to take place in areas where condensation of hydrocarbon vapors occurs. Unvaporized feed droplets readily collect to form coke precursors on any available surface. Heavier boiling components in the feed may be very close to their dew point, and they will readily condense and form coke nucleation sites on even slightly cooler surfaces. Equilibrium flash vaporization calculations often indicate that heavy material is not vaporized at the mixing zone of the riser which is exacerbated by residue processing and short riser residence times also contribute to coke deposits since there is less time for heat to transfer to feed droplets and vaporize them.

Higher boiling range, higher aromaticity feedstocks might be expected to result in worse coking rates but commercial experience has shown that feed quality alone is a poor predictor of which units will experience coking problems. While existing commercial practice has been to increase feed injection steam based on experience, this has been done solely on an basis of experience but provides no guideline based on theory and calculation.

An online article by McClung of Engelhard, "Monitoring FCCU Feed Vaporization", available at http://www.refiningonline.com/engelhardkb/crep/TCR1_7.htm, describes an empirical approach by which feed dew point and feed vaporization could be estimated and used to reduce the extent to which unvaporized feed droplets undergo condensation to coke on unit surfaces, especially in the cool spots in the transfer line (uninsulated hangers) or in the plenum (metal surfaces cooled by wet steam). The approach proposed by McClung was to assume a riser operating temperature above the feed dew point by assuming perfect mixture like in the flash model, but in reality it is not. It would therefore be desirable to develop an improved method of predicting the inherent tendency of a heavy petroleum oil feed to generate coke deposits in the FCC riser while accounting for imperfect mixing in the feed zone. Ideally, the method should be inexpensive, readily available at the refinery, capable of producing quick results and provides ease of monitoring and use so that operating conditions in the FCCU may be adapted to the feed(s) being processed.

SUMMARY OF THE INVENTION

We have now developed a method of predicting the tendency of a heavy oil feed to generate coke deposits in the FCC riser under a given set of operating parameters in the unit; thus, by utilizing operating parameters appropriate to the feed and the particular unit, the formation of coke deposits in the riser and elsewhere in the unit may be minimized.

According to the present invention, a simple way to calculate the margin between the theoretical mix zone temperature under assumed perfect mixing conditions in the fluid catalytic cracking unit feed injection zone and the dew point of the hydrocarbon feed in the mix zone is developed by applying a regression-derived linear model from multiple rigorous model runs.

In the rigorous model, a riser mix zone temperature is calculated based on an enthalpy balance of incoming streams. The hydrocarbon feed dew point in the mix zone is calculated by modelling a number of factors including the feed characteristics and certain operating parameters of the FCC mix zone, as detailed below. This rigorous model then calculates the delta between a riser mix zone temperature and the hydrocarbon feed dew point (the dew point margin) which has been found to correlate with the amount of unvaporized feed and hence to the extent of riser coking.

In the rigorous model a value for the riser mix zone temperature under assumed perfect mixing conditions is calculated by taking account of an number of relevant feed injection zone operating parameters affecting the energy supplied to the mix zone; these parameters include the flow rate (mass or volumetric), and temperature of the feed entering the mix zone, the catalyst circulation mass flow rate from the regenerator and its temperature, the mass flow rate and temperature of the feed injection steam as well as other factors which may be found on an empirical basis to correlate with the amount of unvaporized feed; these factors may include, for example, the volumetric flow rate, composition (MW) and temperature of miscellaneous gases present in the riser mix zone. A value for the dew point of the feed is calculated using these factors as well as the distillation characteristics of the feed and the riser pressure in the mix zone. A riser temperature safety margin is then calculated from the difference between the calculated values of the riser mix zone temperature and the feed dew point. By running this rigorous model multiple times, changing one parameter at a time, a matrix of parameters affecting the change on the dew point margin is generated. From this matrix, a simpler linear mathematical model may then be derived to generate an operating linear model for the refining operation or planning section which can be used on a more regular basis. The regression analysis used for the linear model then enables the amount of unvaporized feed to be reasonably predicted from the combination of the theoretical hydrocarbon feed dew point and theoretical riser mix zone temperature so that the mix zone of the unit can be operated at a temperature which reduces the level of riser coking predicted from this ascertainable margin or, at least, maintains it within levels which are predictable and acceptable.

The method of predicting the rate of coke deposit formation in the riser of the cracking unit and elsewhere is carried out by using the rigorous model to apply a linear regression analysis in order to determine the correlation between the dew point margin (the calculated dew points of the feeds and the calculated temperatures of the feed injection/catalyst mix zone) with the amount of unvaporized feed; from this regression analysis the amount of unvaporized feed can be derived for any combination of the calculated values of the feed dew point and the temperature of the mix zone. Since the amount of unvaporized feed at any given set of operating conditions is correlated with the cumulative coking potential of the feed under those cracking conditions, a prediction of the riser coking tendency is obtained and used in the actual cracking process.

In normal refinery operations, the heavy hydrocarbon oil feed will be injected into the feed injection/catalyst mix zone of the cracking riser at a mix temperature calculated for the feed from a matrixed mathematical model derived from the regressed linear analysis correlating the theoretical hydrocarbon feed dew point and the theoretical riser mix zone temperature factors comprising:

- Feed flow rate and temperature,
- Feed injection steam mass flow rate and temperature,
- Catalyst circulation mass flow rate from the regenerator and temperature,
- Feed weighted average boiling point
- Riser pressure in the riser mix zone.

In operating the FCC process in the unit, the heavy petroleum oil feed is injected into the feed injection/catalyst mix zone of the riser at a temperature correlated to the calculated value of the dew point margin. In order to improve desirable reductions in coking, the temperature of the mix zone is preferably not less than the calculated feed dew point so that substantially no unvaporized feed passes into the riser above the mix zone. In this case, with a positive value of the dew point margin, operation of the unit will be optimized for minimal coking; the unit may, however, be operated with negative values for the dew point margin (dew point higher than the calculated mix zone temperature) with some risk of coking depending on the magnitude of the negative margin.

DRAWINGS

DETAILED DESCRIPTION

Figure 1:
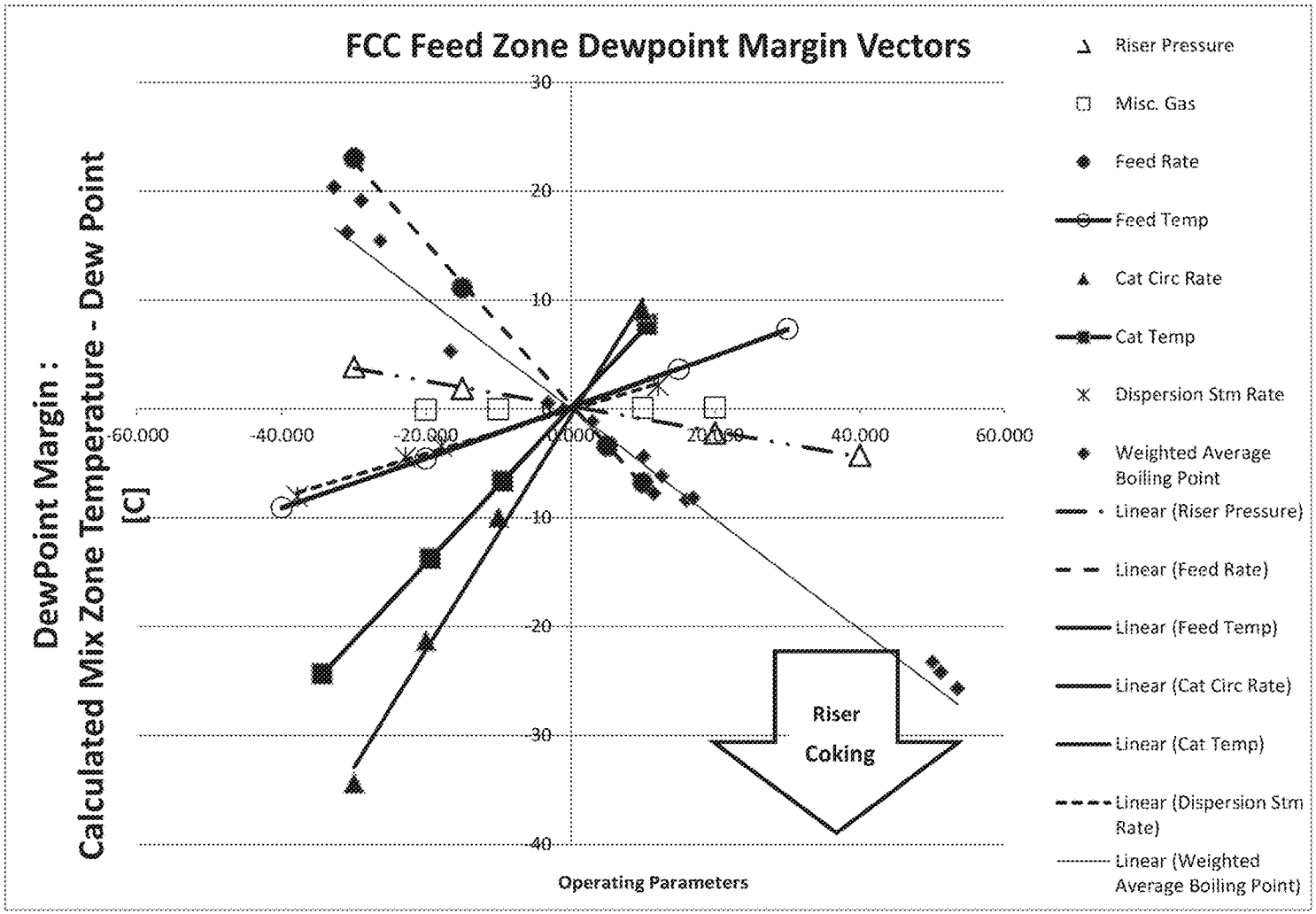
FIG. 1 is a graph relating the dew point safety margin to a selected number of the operating parameters of variables used in the linear regression analysis of the dew point margin of the FCC process.

Riser coking is known as unique problem of FCC units that process heavier feeds, either gas oils with higher end points, resids as in Resid Catalytic Cracking or mixtures of gas oils and resids and has a lower reaction temperature in general in order to control the energy required for vaporization of the feed (approximately 70% of the energy consumed in the FCCU is for vaporization of the feed and this proportion is, of course, higher temperature for the less volatile feeds). Residual feeds, typically with end points above 540° C. (about 1000° F.) e.g. with at least 10 or 20 wt. pct. boiling above 450° C. (about 840° F.), not only require the greatest energy input for vaporization but also pose the greatest likelihood of incomplete vaporization and resultant riser coking. Industrial experience also recommends using more injection steam with the heavier feeds to assist in minimizing feed oil droplet size for improved contacting between the feed and hot catalyst from the regenerator and to assist in reducing feed hydrocarbon partial pressure. The reduction in the pressure of the feed/catalyst contact zone also tends to lower the dew point of the hydrocarbon feed under the selected conditions.

We have found that on the basis of recent riser coking incidents in a major FCCU that enough energy has to be provided to the feed zone to prevent the riser/feed zone from coking. The definition of "enough" energy means energy that vaporizes the hydrocarbon feed at the given feed zone operating conditions (cat:oil ratio, steam:oil ratio, steam pressure, injection nozzle performance etc.); therefore, by applying a safety margin between the calculated feed zone temperature from the process energy balance and the dew point calculation from feed hydrocarbon characteristics and operating conditions, it is possible to monitor and control the degree of safety margin from operating the feed zone at or near the dew point of a given feed. While this calculation and monitoring can be done with rigorous process models on a certain and infrequent basis, the simpler linear model derived from the rigorous empirical model can readily be set up using conventional principles and can then be easily used by the refining operation section or planning section to set up a safety operating envelope to prevent unexpected riser coking.

The objective of the present invention is to calculate a delta between (a) the theoretical (perfect mixture) riser mix zone temperature and (b) the hydrocarbon feed dew point as "riser coking tendency safety margin" and to apply this margin to the actual operation of the unit. Positive values of this difference (mix zone temperature minus dew point) are indicative of the potential for reducing riser coking due to lack of full feed vaporization with higher positive values pointing to the best operating regime for reducing coking although at the expense of higher energy costs. Calculation of this differential is done in the rigorous thermodynamic model by modelling of the following unit operational parameters in the calculation of the differential between (a) the theoretical riser mix zone temperature and (b) the hydrocarbon feed dew point:

- Feed volumetric or mass flow rate, and temperature
- Feed injection (dispersion) steam mass flow rate and temperature
- Catalyst circulation mass flow rate from the regenerator and temperature
- Feed distillation parameters including a plurality of appropriately weighted feed distillation points
- Riser bottom mix zone pressure.

In the rigorous model other mix zone parameters may be optionally factored into the calculation of the dew point margin including the feed pressure, the pressure of the injection steam as well as the volumetric flow rate, composition (MW) and temperature of the miscellaneous gases present in the riser (light hydrocarbon gases from the product recovery section fed in for aeration and metals passivation, or aeration steam, etc. but excluding injection steam and vaporized feed). The feed pressure affects the enthalpy to the system but typically remains fixed for any given unit and is therefore included in the formulation of the rigorous model but not counted as a variable parameter. The same follows for the injection steam pressure and steam temperature as in any given unit these are generally fixed and not variable. Generalization of the rigorous model to other units will require these values to be factored into the rigorous model for that unit, usually as fixed non-variant parameters. The amount, source pressure and composition of the miscellaneous gases obviously affects the feed partial pressure and therefore the dew point and accordingly may be factored in as minor contributors to the calculated dew point margin. Other factors such as the feed density and composition may also be included as found to be appropriate in any selected unit.

The theoretical (perfect mixture) riser mix zone temperature and the hydrocarbon feed dew point are determined from the variables as well as the fixed operating parameters for the selected unit using rigorous models such as Pro (SimSci, Invensys Software) to calculate (a) and (b) above so as to derive the delta between (a) minus (b) as the riser coking safety margin (Dew Point Margin: DPM) as base case. The effects of these parameters on the dependent variables of mix zone temperature and dew point are determined in the derived linear model by generating an initial model including the parameters thought to be relevant and then carrying out a regression analysis, changing one parameter at one time to evaluate the shift on DPM. The model may be progressively developed and refined by the inclusion of additional parameters and by the variation of multiplication factors for the variables. This shift will be a vector for that parameter (for example, catalyst circulation rate). An exemplary graphic summary of these vectors for a selected refinery unit used in the study is shown in FIG. 1. With these vectors and given operating parameters, the DPM will be calculated by the following equation:

$$\text{DPM}=\text{Base Case DPM}+\text{vector for parameter 1}\times(\text{parameter 1 value}-\text{parameter 1 for base case})+\text{vector for parameter 2}\times(\text{parameter 2 value}-\text{parameter 2 for base case})+\ldots$$

To estimate the safety margin the effect of the above parameters was evaluated in the models. Once the modelling technique has been applied for any given unit and feed type (i.e. for the same feeds or similar feeds), the rigorous model may be used to predict the safety margin under selected and known operating conditions by deriving a simpler, linear mathematical model which is essentially a matrix of the trends established by the rigorous model. The derived model can then be used on a routine basis for planning and operational purposes as running rigorous models for future operation to analyze coking tendency is time consuming process and would not be practical from a planning standpoint. The derived model should allow for inputs of the variables found to affect the dew point safety margin DPM and from this a direct value for the dew point safety margin can be directly calculated without separately calculating the theoretical riser mix temperature and feed dew point since these are incorporated into the calculation of the DPM in the derived model according to the shift vectors for the operating parameters which have been found to significant in the development of the rigorous model.

The derived model will accordingly require input of critical variables typically including the catalyst circulation rate and temperature (regenerator temperature), the weighted average boiling point of the feed in use (weighted according to the values taken from the rigorous model), the feed rate and temperature, injection steam rate and riser pressure.

The feed density, composition and pressure may also be factored into the derived linear model as secondary factors in the calculation of the dew point margin. This can be done by using these parameters to formulate pseudo components for the model but since the density increases with the distillation (the heavier feeds with higher end point usually have higher densities) the density need not be factored independently as the distillation has a greater effect on the calculated dew point. The same is true for the feed composition. For any given cracking unit, the values of the injection steam temperature and pressure will normally be fixed and therefore built directly into the model.

Figure 3:
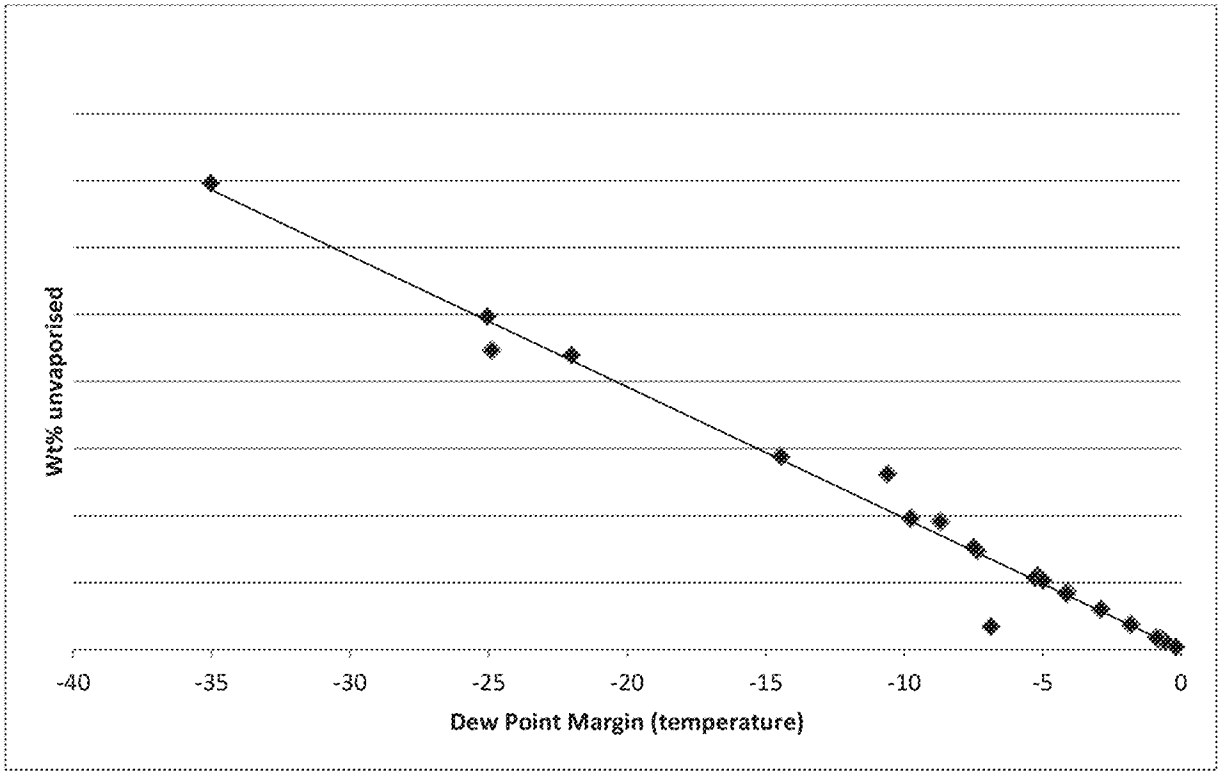
FIG. 3 is a graph showing correlation between the amount of unvaporized feed with the dew point margin predictions.

If the DPM is positive, theoretically, the feed will be 100% vaporized since the dew point marks the onset of condensation by the least volatile components of the feed with decreasing temperature. If the DPM is a negative number, the greater the negative absolute valve, the more feed will not be vaporized but the unit may be operated at negative values although at greater risk of coking if other consideration so require. FIG. 3 shows correlation between the amount of unvaporized feed and the dew point margin (DPM). This amount of unvaporized feed is also derived from the simplified linear regressed model.

Using operating data obtained from an actual FCC unit, the trend of amount of unvaporized feed was calculated from the trend in the riser pressure drop using the above equation and overlapped with the measured trend in riser pressure drop. Of all the evaluated parameters, a positive multiplication factor is applied in the model to the feed injection steam rate which was found to have a significant impact on coking tendency and consequently the safety margin, so while other parameters are allowed to remain at their actual values. The effect in the model of varying the multiplication factor is then determined by applying progressive multiplication factors until a satisfactory fit with data is achieved. A typical multiplication factor of at least 2× or 5× may be adequate depending on the degree of assurance required for the safety margin but for optimal freedom from riser coking, a factor of 10× can safely be applied. Higher factors may be applied, e.g. 12×, 15×, 20× depending on unit performance with various feeds and the degree of operating safety being sought although the minimum value found to provide satisfactory operation will be preferred. Depending on the correlations established in the modelling, multiplication factors may be applied to the other variables but typically will not be required. While a complete match was not obtained initially when the multiplier factor in the model for the feed injection steam remained at the actual value, a change from 1 to 10 in the multiplier factor for the feed injection steam resulted in a significant improvement in the match between the two trends, consistent with what was believed to be an important parameter based on experience. As mentioned above, the theoretical riser mix zone temperature and the hydrocarbon feed dew point, (a) and (b), are both calculated with perfect mixing, while the mixing in the actual unit is not. Feed injection steam is known to have great influence on dynamics of feed and catalyst mixing and for this reason, applying a multiplication factor of this 10× reflects imperfectness of the mixing in the actual plant compared to theoretical mixing calculation done by rigorous model. While the steam pressure technically affects the input of enthalpy to the system in the same way as the feed pressure it is mostly fixed rather than variable for any given unit.

Figure 4:
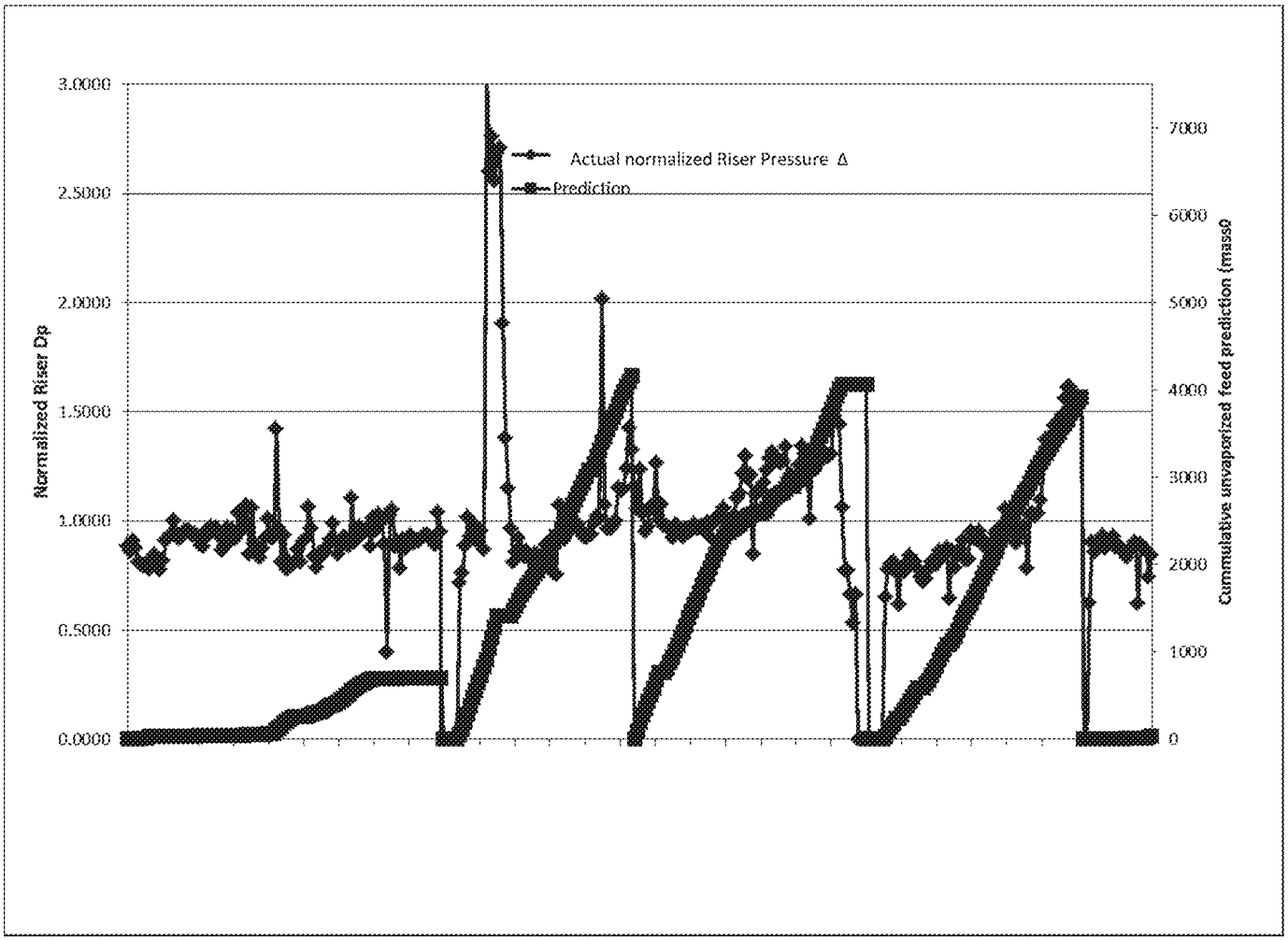
FIG. 4 is a graph showing the cumulative unvaporized feed predictions from the linear regression model relative to actual unit operating data secured between four unit turnarounds.

The safe operating margin on the basis of the dew point of the feed can be developed for the derived model by applying a regression analysis which confirms linearity directly between the dew point safety margin vs key operating variables. FIG. 1 shows how the coking in the FCC feed zone and riser can be minimized by proper selection of the operating parameters for a given feed in a selected cracker. The dew point margin (ordinates) is plotted against the relevant operating parameters (abscissae) in arbitrary units. Positive values of the dew point margin, defined as the calculated mix zone temperature minus the dew point (CC) of the feed; indicate that the mix zone temperature is greater than the dew point of the feed and negative values, less. FIG. 1 shows that increasing riser coking (trending towards the bottom of the graph) is strongly correlated with decreased catalyst circulation rate and decreased catalyst temperature and there is a moderate correlation with feed temperature (not unexpected since the majority of the reaction heat and vaporization heat is supplied by the hot catalyst). There is a strongly negative correlation between feed rate and riser coking and a low-to-moderate negative correlation with riser pressure which, again, is not unexpected since increase in riser pressure will impede flow of catalyst/oil mixture and flow of the vaporized feed up the riser. The pressure in the mix zone is dependent on the extent of coking in the riser and therefore can be expected to increase with time between turnarounds as the cumulative level of coking in the riser increases. This expectation has been confirmed as shown in FIG. 4. There is also a strongly negative correlation between the DPM and weighted feed average boiling point). The feed injection steam rate shows a strong positive correction with decreased riser coking. The miscellaneous gases have a very minor but non-zero effect on the amount of unvaporized feed and, accordingly, factors such as the volumetric flow rate, composition (MW) and temperature of the gases may be factored into the derived model with appropriate weighting.

As noted above the feed distillation characteristics have a significant effect on the expected degree of coking in the riser, with increasing feed end point having a marked effect on the coking tendency. It has been found, however, that a better match between feed distillation and coking is achieved by using a corrected (weighted) average boiling point taking in a number of distillation points with a greater weight given to the 95% point and the end point. The 10% point has also been found, however, to have a role in the extent of riser coking with a minor weighting factor to be applied. In a typical example, the weighted average boiling point might be calculated as: $(10\%\ \text{point}^{0.9}+30\%\ \text{point}+50\%\ \text{point}+70\%\ \text{point}+90\%\ \text{point}+95\%\ \text{point}^{1.1}+\text{final boiling point}^{1.2})/7$. As mentioned above, the feed density, composition and pressure may be used in the rigorous model to formulate the pseudo components but would not necessarily be included in the simpler derived model as their effects are derivative of primary factors such as distillation or, for a given unit, are generally fixed as in the case of feed pressure.

Figure 2:
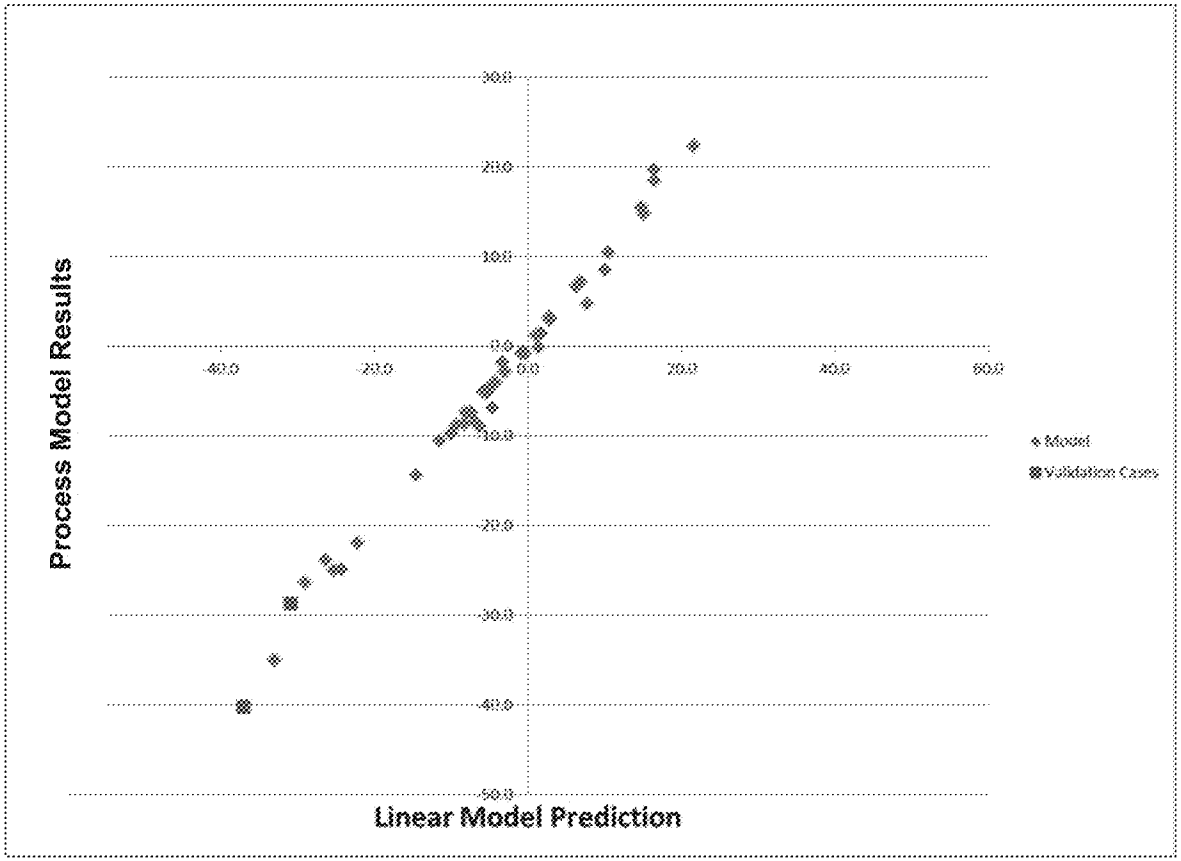
FIG. 2 is a graph demonstrating the dew point margin predictions from the linear regression analysis model.

With any given type of feed and unit, the weighting factors Will be adjusted in the model according to their effect on the dew point margin as empirically determined during the runs. From data such as these, a prediction model for a safe operating margin relative to the dew point of the feed can be derived using linear regression analysis. FIG. 2 shows the linearity of the prediction model relative to a rigorous process model. This model shows the capability of predicting the safety margin between feed dew point vs feed zone theoretical mix zone temperature without using rigorous models. This parameter (safety margin) can be used as monitoring parameter as well as for planning purposes.

As a next step, the derived linear model was explored to estimate the theoretical unvaporized feed vs DPM derived from the model. FIG. 3, shows correlation between the dew point margin (° C.) vs the amount of unvaporized feed. Since riser coking correlates with unvaporized feed, the feed zone mix temperature should endeavor to minimize the unvaporized feed, implying a positive dew point margin (mix temperature greater than feed dew point); on the other hand, increasing mix temperature increases energy costs and so a balance must be made between the acceptable interval between unit turnarounds and operating cost. This suggests that a positive dew point margin of up to 10° C., preferably up to 5° C., is favored although negative margins of no more than 10° C., preferably no more than 5° C., may be tolerated although at the cost of an increased degree of riser coking from unvaporized feed.

Correlation of the model data with actual operating data is shown in FIG. 4 plotting the normalized riser pressure delta relative to the startup value (actual, indicating the extent of riser coking) with the cumulative value predicted from the linear dew point margin model at progressive dates. The minima for both the model predictions and the actual riser pressure values are those at the successive turnarounds and the maxima just before turnarounds. The graph demonstrates reasonable correlation between the predicted and actual data.

The invention claimed is:

1. A method of predicting coke deposit formation tendency in a riser of a fluid catalytic cracking unit having a feed injection/catalyst mix zone in the riser, operating with a heavy hydrocarbon oil feed to the feed injection/catalyst mix zone, comprising:

applying a model to calculate determining both (a) A theoretical riser mix zone temperature and (b) a theoretical hydrocarbon feed dew point from a plurality of factors comprising:

a volumetric flow rate and a temperature for the feed to the mix zone, an injection steam mass flow rate and a temperature for a steam feed to the mix zone, a catalyst circulation mass flow rate to the mix zone from the regenerator and a temperature of the catalyst, a weighted average boiling point of the feed, and a riser pressure in the mix zone;

applying a linear regression analysis to predict a margin between the theoretical hydrocarbon feed dew point and the mix zone temperature as a function of the plurality of factors, and correlating the margin with an amount of unvaporized feed, if any, under a set of operating conditions for the fluid catalytic cracking unit.

2. A method according to claim 1 in which the theoretical riser mix zone temperature is calculated from additional factors including at least one of the pressure of the feed and the pressure of the injection steam.

3. A method according to claim 1 in which the theoretical riser mix zone temperature is calculated from additional factors including at least one of the volumetric flow rate, composition, source pressure and temperature of gases present in the riser.

4. A method according to claim 1 in which the feed weighted boiling point is a weighted average boiling point calculated from weighted values of a plurality of feed distillation points including at least one of the 95% point and the end point.

5. A method according to claim 4 in which the feed weighted boiling point is a weighted average boiling point calculated from weighted values of a plurality of feed distillation points including at least one distillation point between the 10% point and the end point.

6. A method according to claim 1 in which the theoretical riser mix zone temperature is calculated from factors comprising the feed injection steam mass flow rate and its temperature subjected to a positive multiplication factor.

7. A method according to claim 6 in which the theoretical riser mix zone temperature is calculated from a factor comprising the feed injection steam mass flow rate and its temperature subjected to a positive multiplication factor of at least 5×.

8. A method according to claim 6 in which the theoretical riser mix zone temperature is calculated from a factor comprising the feed injection steam mass flow rate and its temperature subjected to a positive multiplication factor of at least 10×.

9. In a fluid catalytic cracking (FCC) process in an FCC unit having a reactor section with a riser in which a heavy hydrocarbon oil feed is catalytically cracked by contact with a hot cracking catalyst from which conversion coke deposited on the catalyst is removed by combustion in a regenerator connected to the reactor section for circulation of the cracking catalyst, the improvement which comprises injecting the heavy hydrocarbon oil feed into a feed injection/catalyst mix zone of the riser at a mix temperature not less than a theoretical hydrocarbon feed dew point calculated for the feed in accordance with the method of claim 1.

10. A fluid catalytic cracking (FCC) process according to claim 9 in which the heavy hydrocarbon oil feed is injected into the feed injection/catalyst mix zone of the riser at a mix temperature not less than 5° C. above the theoretical hydrocarbon feed dew point.

11. A fluid catalytic cracking (FCC) process according to claim 9 in which the heavy hydrocarbon oil feed is injected into the feed injection/catalyst mix zone of the riser at a mix temperature not less than 10° C. above the theoretical hydrocarbon feed dew point.

12. An FCC process according to claim 9 in which the heavy petroleum oil feed has an end point of at least 540° C.

13. An FCC process according to claim 9 in which the heavy petroleum oil feed contains at least 10% wt of components boiling above 450° C.

14. An FCC process according to claim 9 in which the heavy petroleum oil feed contains at least 20% wt of components boiling above 450° C.

15. A fluid catalytic cracking (FCC) process conducted in an FCC unit having a reactor section with a cracking riser in which a heavy hydrocarbon oil feed is catalytically cracked by contact with a hot cracking catalyst from a regenerator connected to the reactor section for circulation of the cracking catalyst, which comprises injecting the heavy hydrocarbon oil feed into a feed injection/catalyst mix zone of the riser at a mix temperature calculated for the feed from the plurality of factors in which the value of the mix temperature is calculated from a matrix mathematical model derived from a regressed linear model analysis correlating theoretical hydrocarbon feed dew point and theoretical riser mix zone temperature according to claim 1.

16. A fluid catalytic cracking (FCC) process according to claim 15 in which the theoretical hydrocarbon feed dew point is calculated from a factor including the feed injection steam mass flow rate and its temperature subjected to a positive multiplication factor up to 10×.

17. A fluid catalytic cracking (FCC) process according to claim 15 in which the heavy hydrocarbon oil feed is injected into the feed injection/catalyst mix zone of the riser at a mix temperature not less than 10° C. above the theoretical hydrocarbon feed dew point.

18. A fluid catalytic cracking (FCC) process according to claim 15 in which the heavy hydrocarbon oil feed is injected into the feed injection/catalyst mix zone of the riser at a mix temperature not less than 20° C. above the theoretical hydrocarbon feed dew point.

19. A method of claim 1 in which linear regression analysis is applied to correlate DPM with an amount of unvaporized feed.

20. A method of claim 1 in which linear regression analysis is applied to predict an amount of unvaporized feed as a function of the plurality of factors.

* * * * *